US005270144A

United States Patent [19]

Moriya

[11] Patent Number: 5,270,144

[45] Date of Patent: Dec. 14, 1993

[54] TONER FOR DEVELOPING STATIC CHARGE IMAGES

[75] Inventor: Yuuichi Moriya, Shizuoka, Japan

[73] Assignee: Tomoegawa Paper Co., Ltd., Tokyo, Japan

[21] Appl. No.: 908,542

[22] Filed: Jun. 30, 1992

Related U.S. Application Data

[63] Continuation of Ser. No. 549,117, Jul. 6, 1990, abandoned.

[30] Foreign Application Priority Data

Jul. 10, 1989 [JP] Japan ..... 1-175434

[51] Int. Cl.[5] ..... G03G 9/087

[52] U.S. Cl. ..... 430/110; 430/111

[58] Field of Search ..... 430/110, 111

[56] References Cited

U.S. PATENT DOCUMENTS 4,111,823 9/1978 Kobayashi et al. ..... 430/110
4,535,049 8/1985 Holda et al. ..... 430/110 X
5,079,123 1/1992 Nanya et al. ..... 430/110 X

FOREIGN PATENT DOCUMENTS 85444 5/1983 Japan ..... 430/110
231562 10/1986 Japan ..... 430/110
240557 10/1988 Japan ..... 430/110
113764 5/1989 Japan ..... 430/110
185663 7/1989 Japan ..... 430/110

*Primary Examiner*—Roland Martin
*Attorney, Agent, or Firm*—Oblon, Spivak, McClelland, Maier & Neustadt

[57] ABSTRACT

A toner for developing static charge images is disclosed which comprises (a) particles of a toner comprising a binder resin, a colorant and at least one wax selected from the group consisting of hardened castor oil, carnauba wax and modified products derived therefrom, and (b) minute particles of a resin which has a glass transition temperature, Tg, of no higher than 120° C., the minute particles having a mean particle size of 0.05 to 0.5 μm and being adhered on surfaces of the particles of the toner.

22 Claims, No Drawings

TONER FOR DEVELOPING STATIC CHARGE IMAGES

This application is a continuation of application Ser. No. 07/549,117, filed on Jul. 6, 1990, now abandoned.

BACKGROUND OF THE INVENTION

1. Field of the Invention

The present invention relates to a dry toner for developing static charge images formed by electrophotography. More particularly, it relates to a toner for low energy fixing which is required in the case of developing static charge images in a hot roll fixing system at a decreased hot roll temperature, a decreased roll pressure, an increased rotation number of rolls or the like conditions.

2. Description of Related Arts

Recently, various alterations or modifications on copiers or printers utilizing electrophotography have been desired in accordance with their popularization. For example, it has been desired to render them to work at low energy in order to allow them to find their way into almost all homes, to render the machines to run at high speeds with view to promoting the spread of the machines into so-called gray areas positioned at a borderline between printers and copiers, to decrease the roll pressure of the machines aiming at simplification of fixing rolls in order to reduce the cost of the machines, and further to reduce the energy required for running the machines to a low level accompanied by the development of multifunctional copiers and printers.

Of the above-described requirements, it is particularly desired for a toner for developing static charge images (hereafter, referred to simply as "toner") that copying machines or printers are run at low fixing energy. Conventionally, investigation for decreasing fixing energy has been focused on the resin contained in the toner and various toners have been proposed which include, for example, those whose molecular weight an/or molecular weight distribution are/is improved, those whose composition has been changed, those which contain one or more additives in the resin.

In order to change the molecular weight and/or molecular weight distribution of the toner resin, a method has been used in which the molecular weight distribution is broadened by decreasing the molecular weight of the lower molecular weight portions of the resin while increasing the molecular weight of the higher molecular weight portions of the resin. Also, a method has been used for this purpose in which the higher molecular weight portions of the resin is crosslinked. However, these methods cause problems that it is necessary to decrease the glass transition temperature of the resin to be used in order for the resulting toner to have a sufficient fixing property and as the result it is inevitable that the storage stability of the toner containing such a resin as described above is deteriorated. In addition, it is difficult to make a toner to have a sufficient fixing property even if efforts are made to improve the fixing property of the toner while maintaining the storage stability thereof.

Another method which has been proposed for lowering the energy upon fixing is a method in which an additional resin or sub-resin is added to the resin contained in the toner as the second component in order to increase the fixing property of the toner. Although this method, which includes the addition of a sub-resin which has a high crystallinity with view to maintaining the glass transition temperature of the resin composition, gives rise to good results with respect to the fixing property and storage stability of the toner, it causes other problems that the presence of a highly crystalline sub-resin results in an abrupt decrease of the melt viscosity of the toner upon hot roll fixing and that offset phenomenon tends to occur because the cohesive force of the toner upon melting is weak. In order to obviate the above problems, it has been proposed to add polyolefin wax which has a high crystallinity to the toner composition. This causes a further problem that components to be dispersed in the toner such as carbon and an charge control agent are difficult to be dispersed in the polyolefin wax, which makes it unsuccessful to obtain a toner having a uniform composition.

SUMMARY OF THE INVENTION

Therefore, it is an object of the present invention is to provide a toner for developing static charge images which has a low fixing temperature, does not deteriorate its storage stability, causes practically no problem with respect to its offset property and is free from problems with respect to not only its thermal characteristics but also practically useful characteristics such as life property and quality of images.

Intensive investigation has been made in order to solve the above-described problems and as the result it has now been found that the use of toner particles which comprises a binder resin containing a specific wax and minute particles of an additional resin adhered on the surfaces of the toner particles gives rises to good results, and thus the present invention has been accomplished.

Accordingly, the present invention provides a toner for developing static charge images, comprising:

(a) particles of a toner comprising a binder resin, a colorant and at least one wax selected from the group consisting of hardened castor oil, carnauba wax and modified products derived therefrom, and (b) minute particles of a resin which has a glass transition temperature, Tg, of no higher than 120° C., the minute particles having a mean particle size of 0.05 to 0.5 μm and being adhered on surfaces of the particles of the toner.

The toner for developing static charge images according to the present invention enables its fixing at low temperatures and exhibits good image characteristics without deteriorating its storage stability and offset property.

DETAILED DESCRIPTION OF THE INVENTION

The above and other objects, effects, features and advantages of the present invention will become more apparent from the following description of preferred embodiments thereof.

Generally, the toner for developing static charge images of the present invention comprises a binder resin which contains a colorant and a specific wax.

At first, detailed description will be made on the wax. The wax is selected from a hardened castor oil, carnauba wax and modified products derived them, which are the first feature of the toner of the present invention.

The term "hardened castor oil" as used herein refers to a hydrogenated product derived from castor oil, for example, castor waxes commercially available from, for example, ITOH OIL MFG CO., LTD. and NIPPON OIL FATS CO., LTD. The modified products derived from castor oil include those whose acid value has been changed by the introduction of an acid group such as a carboxyl group by reacting castor oil with a dibasic acid utilizing one or more hydroxyl groups in one or more side chains thereof. Any dibasic acid may be introduced. However, those dibasic acids are preferred which have 2 to 20 carbon atoms such as formic acid, succinic acid and adipic acid.

On the other hand, the term "carnauba wax" as used herein refers to a kind of a plant wax which is obtained from young leaves of carnauba plant, and modified products derived from carnauba is a substance obtained by introducing an acid group at one or more OH groups in carnauba wax. Commercially available carnauba wax is, for example, CARNAUBA WAX produced by NODAWAX CO., LTD.

According to the present invention, the toner is mixed with the wax, i.e., the above-described hardened castor oil, carnauba wax and modified products derived therefrom, singly or as a mixture. The amount of the wax to be mixed is suitably 5 to 50% by weight, preferably 10 to 40% by weight based on the total weight of the toner composition. If the amount of the wax is below 5% by weight, no sufficient improvement in the fixing property can be obtained. On the other hand, the amount of above 50% by weight is undesirable because the quality of images is deteriorated, for example, the luster of surfaces on which the toner is fixed becomes too high despite an advantage that its fixing property is excellent. Furthermore, it is preferred that the wax has a melting point in the range of 55° to 100° C. Melting points outside the above-described range are undesirable. This is because if it is below 55° C., the storage stability of the resulting toner tends to be deteriorated while the fixing property of the toner is decreased if it is above 100° C.

Next, the minute particles of the additional resin adhered on the surfaces of the toner particles, the second feature of the present invention, will be described in detail below.

In the present invention, the additional resin in the form of minute particles is adhered on the surfaces of the toner particles in order to improve the flowability and storage stability of the toner. The minute particles of the additional resin can be adhered on the surfaces of the toner particles by using conventional mixers such as a turbine type mixer, Henschel mixer and a super mixer or a device which is generally called a surface improver, for example, Nara Hybridization System produced by NARA KIKAI SEISAKUSHO, Mechano-Fusion System produced by HOSOKAWA MICRON CO., LTD., and Surfusing System produced by NIPPON PNEUMATIC INDUSTRY CO., LTD.

The minute particles of the additional resin are preferably in the form of emulsion particles produced by emulsion polymerization. As for main monomer component of the additional resin, those monomers can be employed which are generally used as a resin for toners. Examples of such monomers includes styrene, butyl acrylate, butyl methacrylate, and methyl methacrylate. The mean particle size of the minute particles of the additional resin must be in the range of 0.05 to 0.5 μm. If it is smaller than 0.05 μm, the dispersion of the minute particles on the surfaces of the toner particles tends to be poor while the minute particles are difficult to be adhered on the surfaces of the toner particles if it is larger than 0.5 μm. The glass transition temperature, Tg, of the minute particles of the additional resin must be no higher than 120° C., preferably no higher than 90° C. If the minute particles of the additional resin used have a Tg value of higher than 120° C., the fixing property of the resulting toner is deteriorated.

The minute particles of the additional resin are used in an amount such that they can cover preferably 20 to 80% of the total surface of the toner particles, which corresponds in other words to an amount such that the minute particles are adhered on the surfaces of the toner particles in a proportion of 5 to 30 parts by weight of the minute particles per 100 parts by weight of the toner particles.

The toner for developing static charge images according to the present invention can be produced by mixing the wax with the binder resin, colorant and other additives in predetermined proportions and melt-kneading the mixture followed by pulverizing and classifying it to form toner particles and then adhering the minute particles of the additional resin on the surfaces of the toner particles by using the above-described adhering method.

The binder resin includes, for example, polystyrene, styrene/acrylies, polyacrylate, polyethylene, styrene/-butadiene copolymer, polyamide, polyvinyl chloride, vinyl chloride/vinyl acetate copolymer, coumarone/indene resin and polyester. The styrene acrylics is a coplymer comprising at least one monomer selected from each of the styrene monomer group and acrylic monomer group as described in more detail below. The styrene monomer group comprises monomers such as styrene, o-methylstyrene, m-methylstyrene, p-methylstyrene, α-methylstyrene, p-ethylstyrene, 2,4-dimethylstyrene, p-n-buthylstyrene, p-tert-buthylstyrene p-n-hexylstyrene, p-n-octhylstyrene, p-n-nonylstyrene, p-n-decylstyrene, p-n-dodecylstyrene, pmethoxylstyrene, p-phenylstyrene, p-chlorostyrene, and 3,4-dichlorostyrene; the acrylic monomer comprises unsaturated mono-olefins such as ethylene, propylene, butylene an isobutylene; vinyl esters such as vinyl chloride, vinyl bromide, vinyl fluoride, vinyl acetate, vinyl propionate, vinyl benzoate and vinyl butyrate; α-methylene aliphatic monocarboxylic acid esters such as methyl acrylate, ethyl acrylate, ethyl acrylate, n-butyl acrylate, isobutyl acrylate, propyl aceylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, isobutyl methacrylate, n-octyl methacrylate, dodecyl methacrylate, lauryl methacrylate, 2-ethylhexyl methyacrylate, stearyl methacrylate, phenyl methacrylate, dimethylaminoethyl methacrylate and diethylaminoethyl methacrylate; acrylic acid and methacrylic acid derivatives such as acrylionitrile, methacrylonitrile and acrylamide; vinyl ethers such as vinulmethyl ether, vinylethyl ether and vinulisobutyl ether; vinyl ketones such as vinylmethyl ketone, vinylhexyl ketone and methylisopropenyl ketone; and N-vinyl compounds such as N-vinylpyrrole, N-vinylcarbazole, N-vinylindole and N-vinylpyrrolidine. The colorant includes pigments and dyes which are used usually as a colorant for toners for developing static charge images. Examples thereof include carbon black, nigrosine dye, aniline dye, Chrome Yellow, Ultramarine Blue, Methylene Blue Chloride, Rose Bengale, magnetite and ferrite. If desired, various auxiliaries can be used as the other additives. Examples thereof include charge control agents, antioxidants, pigments, and flowability improving agents such as colloidal silica and colloidal alumina.

The toner for developing static charge images according to the present invention includes one or more of a hardened castor oil, carnauba wax and modified products derived from them which are highly crystalline and have a melting point of 55° to 100° C., resulting in that upon heat treatment with hot rolls the melt viscosity of the toner decreases abruptly and the toner is melted completely at a relatively low fixing temperature (130° to 150° C.), which improves effectively the fixing strength of the toner onto a surface of transfer paper. On the other hand, the specific wax used in the present invention does not cause offset phenomenon which would other occur because of specific mechanism of the wax that it has a strong cohesive force upon heat melting and a low affinity for hot rolls. Furthermore, according to the present invention, the flowability of the toner is improved because minute particles of the additional resin are adhered on the surfaces of the toner particles, thus imparting a good storage stability to the toner.

EXAMPLES

The present invention will be explained in greater detail hereinbelow with reference to examples. In the examples, all parts are by weight.

EXAMPLE 1

| | |
|---|---|
| Styrene/n-butyl acrylate/methyl methacrylate copolymer (Mn = 5,000, Mw = 140,000, Mw/Mn = 28.0) | 100 parts |
| Hardened castor oil ("CASTOR WAX", produced by ITOH OIL MFG CO., LTD.) | 30 parts |
| Azo dye ("BONTRON S-34" produced by ORIENT CHEMICAL INDUSTRIAL CO., LTD.) | 3.5 parts |
| Carbon black ("MA-100", produced by MITSUBISHI CHEMICAL INDUSTRIAL CO., LTD.) | 7 parts |
| Polypropylene ("VICKOL 550P", produced by SANYO CHEMICAL INDUSTRIAL CO., LTD.) | 4 parts |

The mixture of the above-described composition was heat-melted and kneaded, pulverized and classified to obtain negative-chargeable toner particles having a mean particle size of 12 μm. Then 15 parts of minute particles of a resin (emulsion particles of styrene/butyl acrylate copolymer; Tg=82° C., mean particle size=0.2 μm) were mixed with 100 parts of the toner particles thus obtained, and the resulting mixture was treated at 58° C. for 15 minutes by using Henschel mixer so that the minute particles of the copolymer were adhered onto the surfaces of the toner particles. Thereafter, hydrophobic silica was added to the resulting composition in a proportion of 0.2 part of hydrophobic silica per 100 parts of the toner to obtain the toner of the present invention.

EXAMPLE 2

| | |
|---|---|
| Styrene/n-butyl acrylate/methyl methacrylate copolymer (Mn = 5,000, Mw = 140,000, Mw/Mn = 28.0) | 100 parts |
| Carnauba wax ("CARNAUBA WAX", produced by NODAWAX CO., LTD.) | 30 parts |
| Azo dye ("BONTRON S-34" produced by ORIENT CHEMICAL INDUSTRIAL CO., LTD.) | 3.5 parts |
| Carbon black ("MA-100", produced by MITSUBISHI CHEMICAL INDUSTRIES CO., LTD.) | 7 parts |
| Polypropylene ("VICKOL 550P", produced by SANYO CHEMICAL INDUSTRIES CO., LTD.) | 4 parts |

The mixture of the above-described composition was heat melted and kneaded, pulverized and classified to obtain negative-chargeable toner particles having a mean particle size of 12 μm. Then 15 parts of minute particles of a resin (emulsion particles of styrene/butyl acrylate copolymer; Tg=82° C., mean particle size=0.2 μm) were mixed with 100 parts of the toner particles thus obtained, and the resulting mixture was treated at 58° C. for 15 minutes by using Henschel mixer so that the minute particles of the copolymer were adhered onto the surfaces of the toner particles. Thereafter, hydrophobic silica was added to the resulting composition in a proportion of 0.2 part of hydrophobic silica per 100 parts of the toner to obtain the toner of the present invention.

EXAMPLE 3

| | |
|---|---|
| Styrene/n-butyl acrylate/methyl methacrylate copolymer (Mn = 5,000, Mw = 140,000, Mw/Mn = 28.0) | 100 parts |
| Hardened castor oil ("CASTOR WAX", produced by ITOH OIL MFG CO., LTD.) | 30 parts |
| Azo dye ("BONTRON S-34" produced by ORIENT CHEMICAL INDUSTRIAL CO., LTD.) | 3.5 parts |
| Carbon black ("MA-100", produced by MITSUBISHI CHEMICAL INDUSTRIES CO., LTD.) | 7 parts |
| Polypropylene ("VICKOL 550P", produced by SANYO CHEMICAL INDUSTRIES CO., LTD.) | 4 parts |

The mixture of the above-described composition was heat-melted and kneaded, pulverized and classified to obtain negative-chargeable toner particles having a mean particle size of 12 μm. Then 15 parts of minute particles of a resin (emulsion particles of PMMA (polymethyl methacrylate); Tg=90° C., mean particle size=0.25 μm) were mixed with 100 parts of the toner particles thus obtained, and the resulting mixture was treated at 58° C. for 15 minutes by using Henschel mixer so that the minute particles of the copolymer were adhered onto the surfaces of the toner particles. Thereafter, hydrophobic silica was added to the resulting composition in a proportion of 0.2 part of hydrophobic silica per 100 parts of the toner to obtain the toner of the present invention.

COMPARATIVE EXAMPLE 1

| | |
|---|---|
| Styrene/n-butyl acrylate/methyl methacrylate copolymer (Mn = 5,000, Mw = 140,000, Mw/Mn = 28.0) | 100 parts |
| Azo dye ("BONTRON S-34" produced by ORIENT CHEMICAL INDUSTRIAL CO., LTD.) | 3 parts |
| Carbon black ("MA-100", produced by MITSUBISHI CHEM- | 5.5 parts |

-continued

| | |
|---|---|
| ICAL INDUSTRIES CO., LTD.) | |
| Polypropylene ("VISKOL 550P", produced by SANYO CHEMICAL INDUSTRIES CO., LTD.) | 3 parts |

The mixture of the above-described composition was heat-melt and kneaded, pulverized and classified to obtain negative-chargeable toner particles having a mean particle size of 12 μm. Thereafter, hydrophobic silica was added to the resulting composition in a proportion of 0.2 part of hydrophobic silica per 100 parts of the toner particles to obtain a toner for developing static charge images for comparison.

COMPARATIVE EXAMPLE 2

A toner for developing static charge images for comparison was obtained by repeating the same procedures as in Example 2 except that the adhesion of the minute particles of the resin was omitted.

Four (4) parts of each of the toners for developing static charge images according to Examples 1 to 3 of the present invention and comparative toners according to Comparative Examples 1 and 2 were mixed with 96 parts of a noncoated ferrite powder carrier to prepare a developer. Using the toner and developers, the following tests were conducted to evaluate various characteristics of the toner.

(1) Lowest Fixing Temperature

A fixing device composed of a hot roll with its surface layer being formed by polytetrafluoroethylene and a press roll with its surface layer being formed by a silicone rubber was adjusted so as to be run at a roll pressure of 30 kg/cm and at a roll speed of 170 mm/sec. The temperature of the hot roll was gradually changed as shown in Table 1 and sample toners which had been imagewise transferred on transfer paper through a commercially available copier were each fixed on the paper. The fixed images were each rubbed with a cotton pad ("PPC PAD", a trade name for a product by DAINIC CO., LTD.). Then, the lowest possible set-up temperature at which the fixed images exhibited sufficient rubbing resistance was defined as lowest fixing temperature of the sample toner concerned.

(2) Non-offset Temperature Range

Each of the sample toners was transferred on transfer paper and fixed by using the above-described fixing device. This procedure was repeated at various hot roll temperatures and observation was made whether or not blurring did occur in blank portion of the transfer paper. The temperature range within which no blurring did occur was defined as a non-offset temperature range.

(3) Storage Stability

After allowing them to stand in an atmosphere at 45° C. for 2 weeks or at 50° C. for 8 hours, the flowability of the toners was evaluated visually.

(4) Image Quality

Continuous copying tests with the sample toner, and the quality of the toner images was observed visually.

Of the above-described test items, results of the tests on the lowest fixing temperature, non-offset temperature range and storage stability are shown in Table 1 below.

With respect to the image quality, the toners obtained in Examples 1 to 3 showed images of good quality after 30,000 copies or more. On the other hand, the toner obtained in Comparative Example 2 caused blocking in the hopper, which made it impossible to further carry out the continuous copying test although it showed good initial image.

TABLE 1

| | Lowest Fixing Temprature (°C.) | Non-Offset Temperature Range (°C.) | Storage Stability |
|---|---|---|---|
| Example 1 | 162 | 145–210 | ○ |
| Example 2 | 168 | 150–200 | ○ |
| Example 3 | 166 | 145–210 | ○ |
| Com. Ex. 1 | 190 | 160–210 | ○ |
| Com. Ex. 2 | 170 | 160–200 | X |

Note:
Symbol "○" indicates that storage stability was good.
Symbol "X" indicates that storage stability was poor.

As will be apparent from the results of the image quality test and the results shown in Table 1 above, the toner for developing static charge images according to the present invention had a low fixing temperature, a broad non-offset temperature range, good image quality and good storage stability. On the other hand, the toner obtained in Comparative Example 1 showed a high lowest fixing temperature, which means that the comparative toner is insufficient as a low energy fixing toner. The toner obtained in Comparative Example 2 showed a poor storage stability and its image quality was unacceptable for practical purposes.

The invention has been described in detail with respect to embodiments, and it will now be apparent from the foregoing to those skilled in the art that changes and modifications may be made without departing from the invention in its broader aspects, and it is the invention, therefore, in the appended claims to cover all such changes and modifications as fall with the true spirit of the invention.

I claim:

1. A toner for developing static charge images, comprising:

(a) particles of a toner comprising a binder resin, a colorant and at least one wax selected from the group consisting of hardened castor oil, carnauba wax and modified products derived therefrom, and (b) minute particles of a resin which has a glass transition temperature, Tg, of no higher than 120° C., said minute particles having a mean particle size of 0.05 to 0.5 μm and being adhered on surface particles of said toner.

2. The toner for developing static charge images as claimed in claim 1, wherein said wax is carnauba wax.

3. The toner for developing static charge images as claimed in claim 1, wherein said wax is modified products derived from carnauba wax.

4. The toner for developing static charge images as claimed in claim 3, wherein said modified products derived from carnauba wax are products obtained by introducing an acid group at one or more hydroxyl groups in carnauba wax.

5. The toner for developing static charge images as claimed in claim 1, wherein said wax has a melting point in the range of 55°–100° C.

6. The toner for developing static charge images as claimed in claim 1, wherein said minute resin particles have a glass transition temperature of no higher than 90° C.

7. The toner for developing static charge images as claimed in claim 1, wherein said wax is hardened castor oil.

8. The toner for developing static charge images as claimed in claim 1, wherein said wax is modified products derived from hardened castor oil.

9. The toner for developing static charge images as claimed in claim 8, wherein said modified products are a reaction product between said hardened castor oil and a dibasic carboxylic acid.

10. The toner for developing static charge images as claimed in claim 9, wherein said dibasic carboxylic acid is a dibasic fatty acid having 2 to 20 carbon atoms.

11. The toner for developing static charge images as claimed in claim 10, wherein said dibasic fatty acid is selected from formic acid, succinic acid and adipic acid.

12. The toner for developing static charge images as claimed in claim 1, wherein said binder resin is at least one resin selected from the group consisting of polystyrene, styrene/acrylics/polyacrylate, polyethylene, styrene/butadiene copolymer, polyamide, polyvinyl chloride, vinyl chloride/vinyl acetate copolymer, coumarone/indene resin and polyester.

13. The toner for developing static charge images as claimed in claim 12, wherein said binder resin is styrene/acrylics.

14. The toner for developing static charge images as claimed in claim 1, wherein said wax is present in a proportion of 5 to 50% by weight based on the total weight of the toner.

15. The toner for developing static charge images as claimed in claim 14, wherein said wax is present in a proportion of 10–40% by weight based on the total weight of the toner.

16. The toner for developing static charge images as claimed in claim 1, wherein said resin for said minute particles is a resin whose main monomer component is at least one monomer selected from the group consisting of styrene, butyl acrylate, butyl methacrylate and methyl methacrylate.

17. The toner for developing static charge images as claimed in claim 1, wherein said minute particles of resin are present so as to cover 20 to 80% of total surface area of said toner particles.

18. The toner for developing static charge images as claimed in claim 1, wherein said minute particles of resin are present in an amount of 5 to 30 parts by weight per 100 parts by weight of said toner.

19. The toner for developing static charge images as claimed in claim 1, wherein said colorant is selected from the group consisting of carbon black, nigrosine dye, aniline dye, Chrome Yellow, Ultramarine Blue, Methylene Blue Chloride, Rose Bengale, magnetite and ferrite.

20. The toner for developing static charge images as claimed in claim 1, wherein said toner further comprises an charge control agent, an antioxidant and a flowability improving agent.

21. The toner for developing static charge images as claimed in claim 1, wherein said flowability improving agent is selected from the group consisting of colloidal silica and colloidal alumina.

22. A toner for developing static charge images, comprising:

(a) particles of a toner comprising a binder resin, a colorant and at least one wax selected from the group consisting of hardened castor oil, carnauba wax and modified products derived therefrom, and (b) minute particles of a resin which has a glass transition temperature, Tg, of no higher than 120° C., said particles having a mean particle size of 0.05 to 0.5 μm and being adhered on surface particles of said toner by a surface modifying machine.

* * * * *